US006478615B1

(12) United States Patent
Kuo

(10) Patent No.: US 6,478,615 B1
(45) Date of Patent: Nov. 12, 2002

(54) STACKED ELECTRICAL CARD CONNECTOR ASSEMBLY

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/023,973

(22) Filed: Dec. 17, 2001

(51) Int. Cl.[7] ..... H01B 13/60
(52) U.S. Cl. ..... 439/541.5; 439/67; 439/607
(58) Field of Search ..... 39/64, 79, 541.5, 39/67, 77, 607, 610

(56) References Cited

U.S. PATENT DOCUMENTS 5,267,876 A * 12/1993 Rupert et al. ..... 439/541.5
5,299,089 A * 3/1994 Lwee ..... 439/541.5
5,324,204 A * 6/1994 Lwee ..... 439/64
5,688,130 A * 11/1997 Huang ..... 439/79
5,709,568 A * 1/1998 Pan et al. ..... 439/541.5
6,183,273 B1 * 2/2001 Yu et al. ..... 439/541.5

* cited by examiner

*Primary Examiner*—Gary Paumen
(74) *Attorney, Agent, or Firm*—Wei Te Chung

(57) ABSTRACT

A stacked electrical card connector assembly (1) includes an upper connector (10), a lower connector (20), and a flexible printed circuit (FPC) (30) simultaneously connecting with the upper connector (10) and the lower connector (20). The FPC (30) has a first contacting portion (32) urged by spring arms (226) of a lower frame (22) of the lower connector (20) and a second contacting portion (34) connected with a plurality of signal contacts (16) defined in an upper header (12) of the upper connector (20).

1 Claim, 9 Drawing Sheets

STACKED ELECTRICAL CARD CONNECTOR ASSEMBLY

BACKGROUND OF THE INVENTION

1. Field of the Invention

The present invention relates to the art of electrical connectors, more particularly to an improved electrical connector assembly for connecting one or more electrical cards to a printed circuit board (PCB).

2. Description of the Related Art

With the tendency of reducing the size of a computer device, demand has arisen for increasing its data storage capacity at low cost. Generally, electrical cards, such as memory cards, are data storage devices which are electrically connected to the computer device. The electrical cards are portable instruments that are readily inserted and extracted from electrical connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors are arranged in "dual port" or stacked configurations. Examples of this electrical connector assembly are disclosed in U.S. Pat. Nos. 5,364,204 and 5,798,130. Such electrical connector assembly commonly includes an upper connector and a lower connector stacked together for receiving individual electrical cards therein and respectively electrically connecting the electrical cards to a PCB. This electrical connector assembly meets the requirement of high-capacity data transmission since it can simultaneously receive two same or different types of electrical cards therein. However, the overall size of the electrical connector assembly is not reduced at all since the electrical connector assembly simply stacks two individual electrical connectors together. It is not suitable to install such electrical connector assembly in a Notebook-PC for it occupies too much space. Furthermore, data transmission of the electrical connector assembly is achieved through independent signal contacts in an upper header of the upper connector and a lower header of the lower connector, and the signal contacts have to be directly soldered to the PCB or be connected to the PCB through a separate transition device soldered on the PCB. One problem associated with soldering the entire signal contacts of the connector assembly to the PCB is that it is difficult to solder each individual tail and ensure that none of the closely spaced solder pads is short circuited to an adjacent solder pad. In addition, if the connector assembly need be replaced or removed from the PCB, the unsoldering process can be extremely labor intensive and costly.

Therefore, the present invention is directed to solving the above problems by providing a low-profile stacked electrical connector assembly which can be used for receiving two electrical cards therein.

SUMMARY OF THE INVENTION

Accordingly, an object of the present invention is to provide a stacked electrical connector assembly having reduced height thereby saving the occupied space on a PCB where the connector assembly is mounted Another object of the present invention is to provide a stacked electrical connector assembly with improved transition device which simplifies the assembling process of the connector assembly. The other two copending applications with unknown serial numbers, the same applicant, the same title, the same assignee and the same filing date, also disclose some other approaches to cure the shortcomings of the prior arts.

To achieve the above objects, a stacked electrical card connector assembly in accordance with the present invention comprises an upper connector, a lower connector, and a transition device respectively connected with the upper and lower connectors. The lower connector has a lower header and a lower metallic frame assembled to the lower header, and the lower frame has an opening defined therein with a plurality of spring arms extending oppositely in the opening. The upper connector has an upper header with a metallic shield covered on the upper header and a plurality of signal contacts defined in the upper header, and wherein the shield has a plurality of grounding pins extending out from one edge thereof. The transition device has a first contacting portion and a second contacting portion. The first contacting portion is contacted with the spring arms of the lower connector and the second contacting portion is connected with the signal contacts and grounding pins of the upper connector.

With such a design, data of different electrical cards received in the upper and lower connectors can be simultaneously transferred through one transition device thereby decreasing the whole height of the connector assembly. The transition device can be connected to a PCB without soldering the transition device to the PCB such that the assembling progress is simplified.

Other objects, advantages and novelty features of the invention will become more apparent from the following detailed description when taken in conjunction with the accompanying drawings. Two other copending applications with unknown Serial numbers but with the same title, same applicant, same assignee and same filing date, also disclose some other approaches to overcome the shortcomings of the prior arts.

DESCRIPTION OF THE PREFERRED EMBODIMENT

Figure 1:
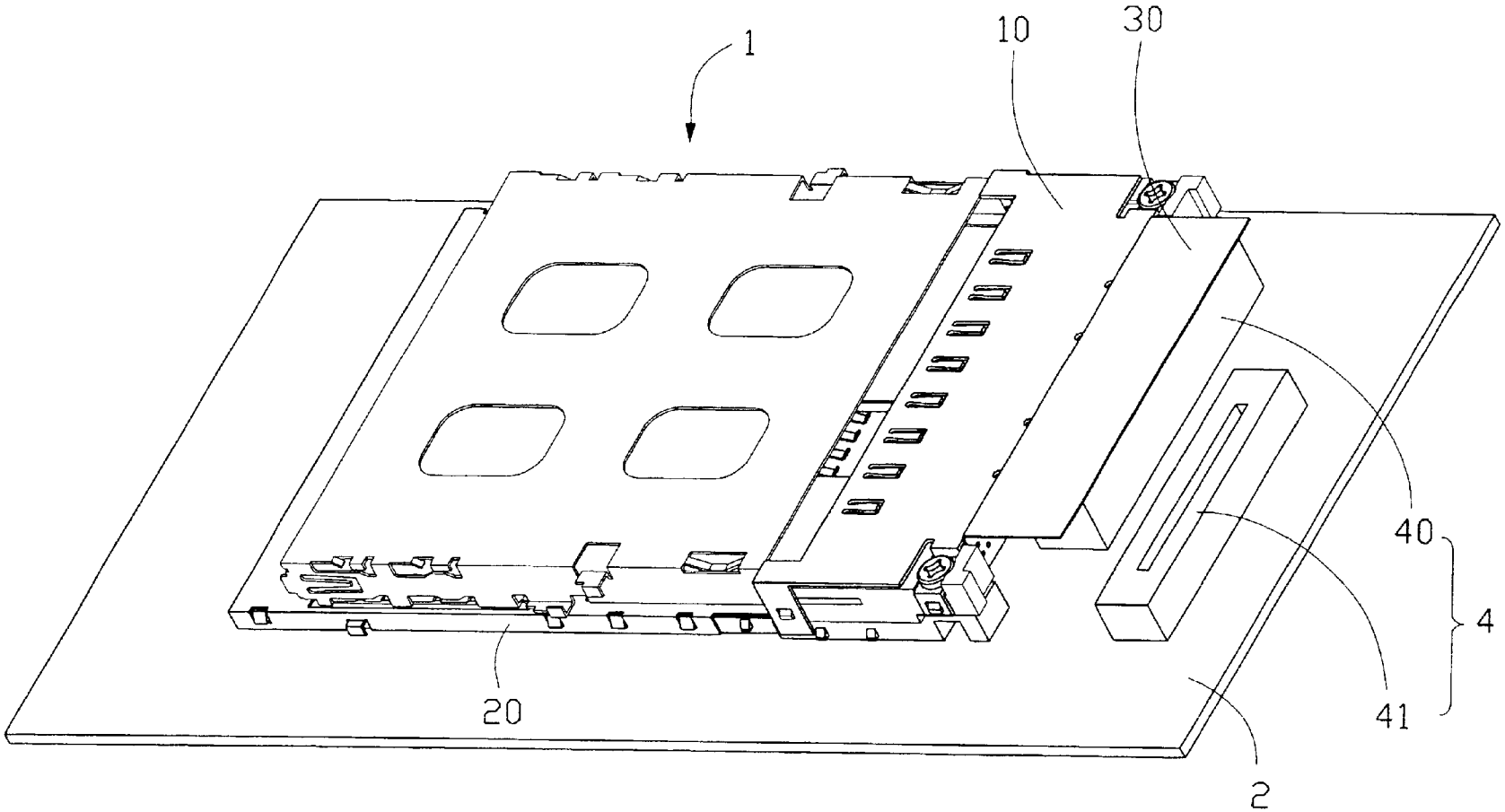
FIG. 1 is an assembled view of a stacked electrical connector assembly in accordance with a preferred embodiment of the present invention including a lower connector, an upper connector and a flexible printed circuit (FPC), in conjunction with a board-to-board connector and a PCB.

Reference will now be made to the drawing figures to describe the present invention in detail.

Referring to FIG. 1, a stacked electrical card connector assembly 1 in accordance with the present invention comprises an upper electrical connector 10, a lower connector 20, and a flexible printed circuit (FPC ) 30 for connecting both the upper connector 10 and the lower connector 20 with a printed circuit board (PCB) 2. The connector assembly 1 is mounted on the PCB 2 with a plug portion 40 of a board-to-board connector 4 connected with one end of the FPC 30, and a receptacle portion 41 of the connector 4 mounted on the PCB 2.

Figure 2:
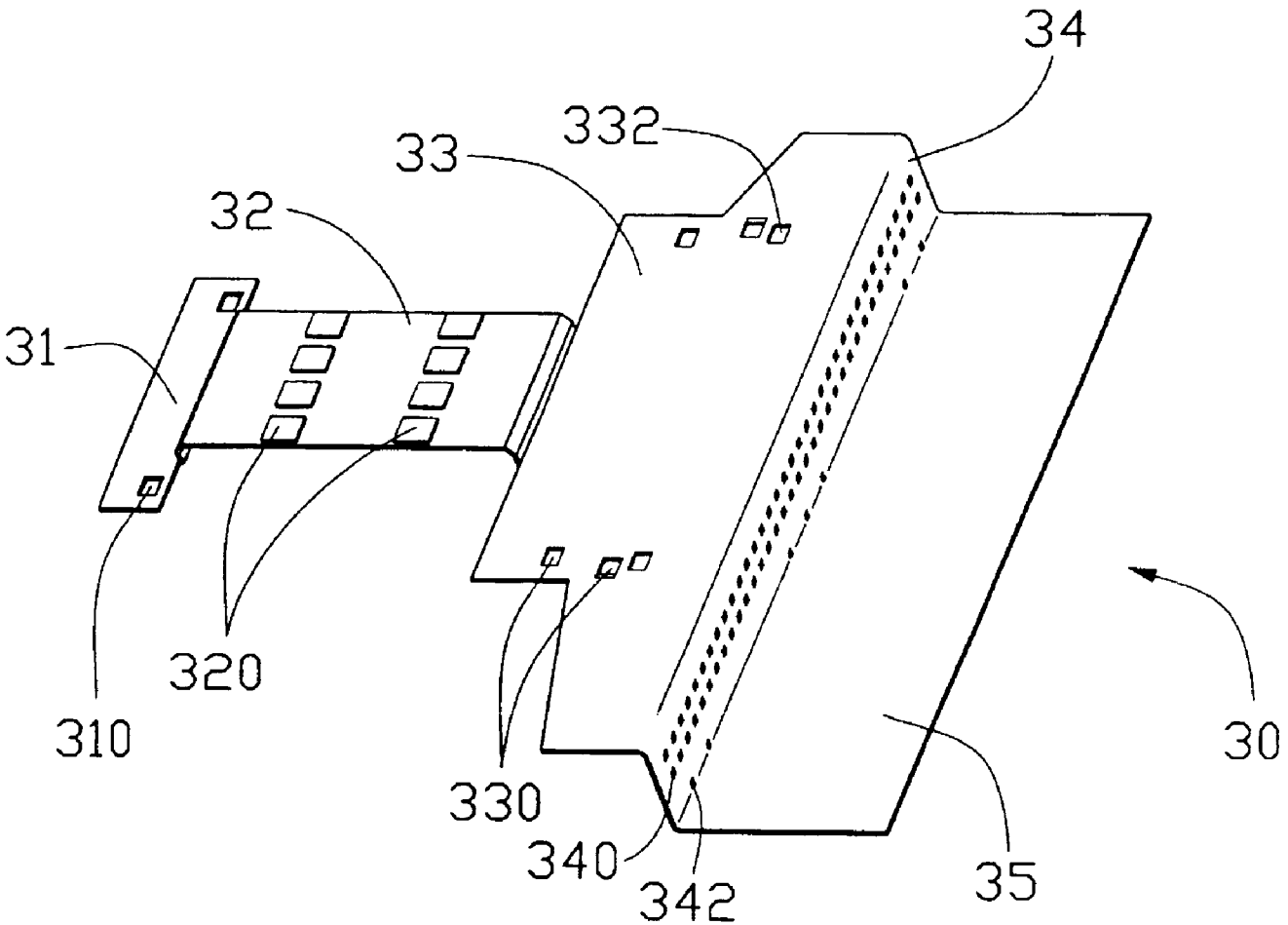
FIG. 2 is a perspective view of the FPC of FIG. 1, functioning as a transition device between electrical cards and the PCB.

Referring to FIG. 2, the FPC 30, functioning as a transition device, includes a first locking portion 31 defined in one end thereof, a tail portion 35 defined in the other end thereof, and a second locking portion 33 defined in a middle thereof. The first and second locking portions 31 and 33 respectively define a plurality of securing holes 310 and 330, 332 therein. A first contacting portion 32 is defined between the first and second locking portions 31, 33, and two rows of solder pads 320 are arranged on one side surface of the first contacting portion 32. A second contacting portion 34 is defined between the second locking portion 33 and the tail portion 35. The second contacting portion 34 bends vertically to the second locking portion 33, and defines two rows of first solder holes 340 at one side near the second locking portion 33 and one row of second solder holes 342 at the other side near the tail portion 35.

Figure 3:
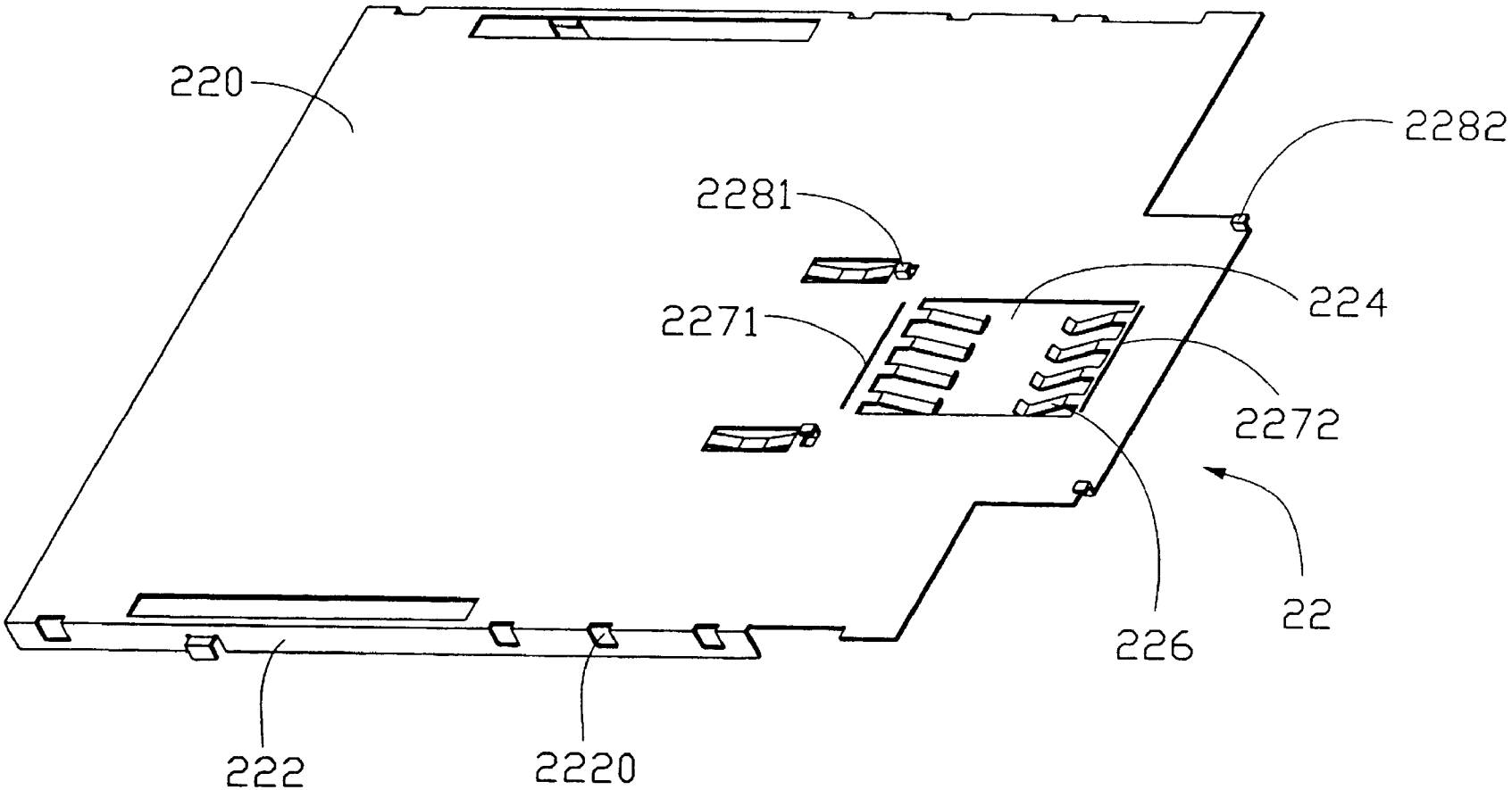
FIG. 3 is a perspective view of a lower frame of the lower connector of FIG. 1.

Referring to FIG. 3, A lower frame 22 of the lower connector 20 is formed by stamping a metal sheet. The lower frame 22 has a base plate 220, opposite sides of the base plate 220 are bent vertically and downwardly to form a pair of flanges 222, and a plurality of locking holes 2220 are disposed along the flanges 222. The base plate 220 also defines an opening 224 near one end thereof, and two rows of spaced spring arms 226 extends oppositely in the opening 224 respectively from opposite sides of the opening 224. Two locating slots 2271, 2272 are respectively located behind both sides of the opening 224 where the spring arms 226 extend out. Two pairs of latches 2281, 2282 are respectively located behind the two slots 2271, 2272 such that the latches 2281, 2282 surround the opening 224 and the slots 2271, 2272.

Figure 4:
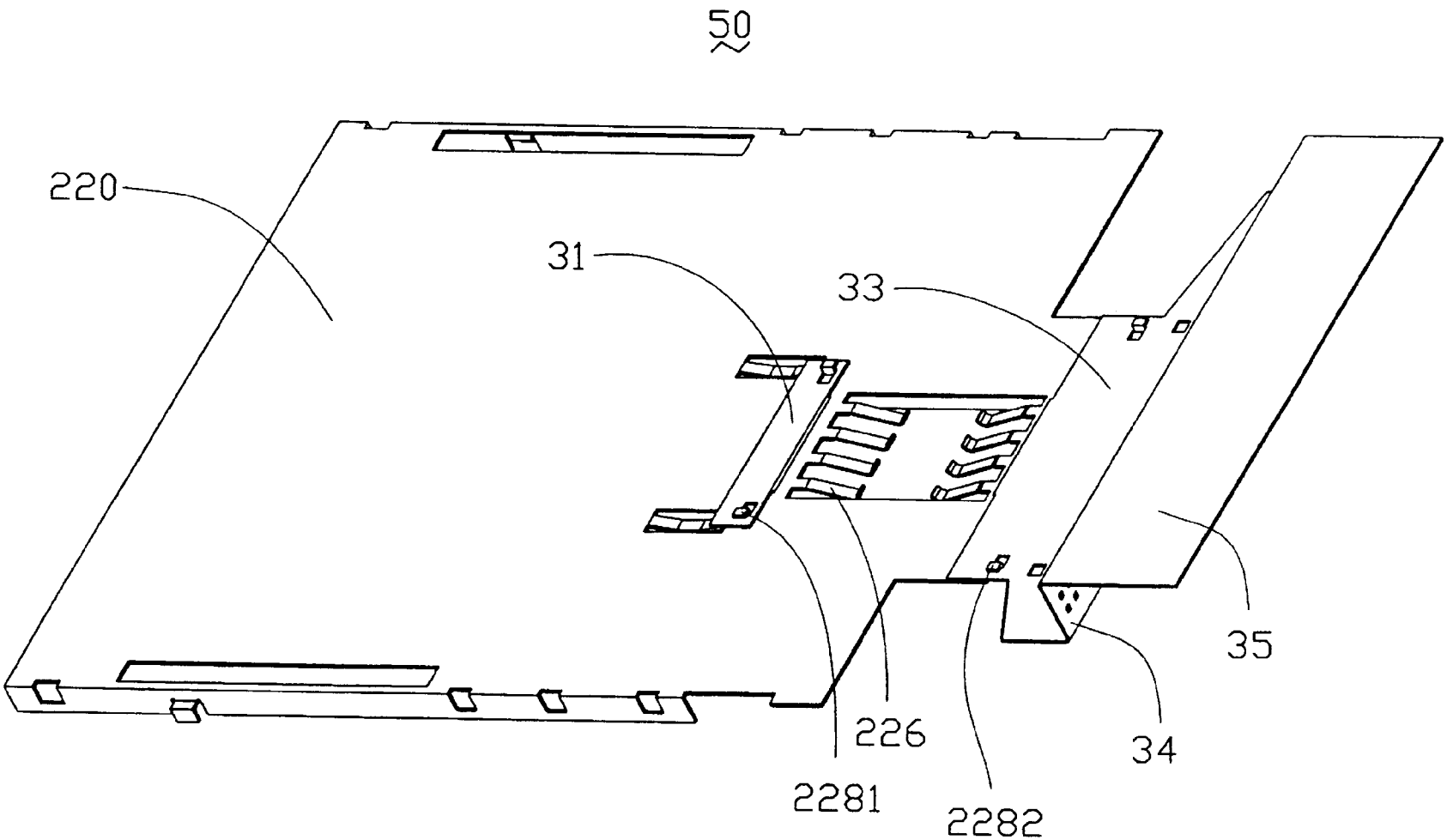
FIG. 4 is a perspective view showing the FPC of FIG. 2 connected with the lower frame of FIG. 3.
Figure 5:
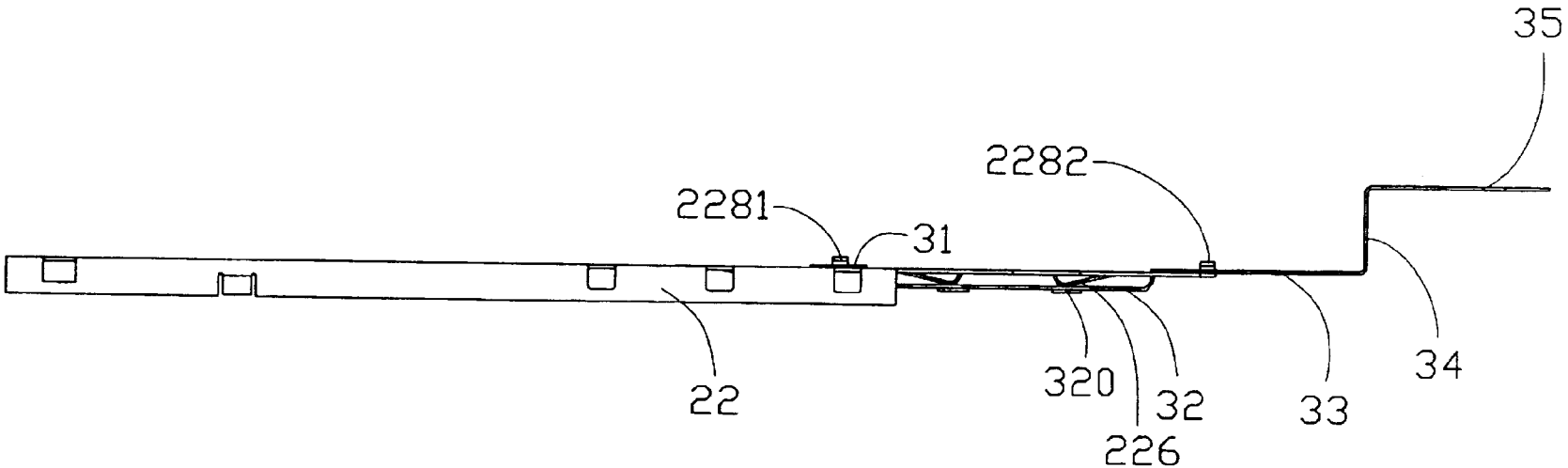
FIG. 5 is a side view of FIG. 4

FIGS. 4, and 5 show the FPC 30 is assembled to the lower frame 22 so as to form a subassembly 50. The first locking portion 31 of the FPC 30 extends through the locating slot 2272, extends across the opening 226 along a bottom surface of the lower frame 22, finally extends upwardly through the locating slot 2271 from the bottom surface of the lower frame 22 with the securing holes 310 engaging with the latches 2281. At this position, each spring arm 226 in the opening 224 resists a corresponding solder pad 320 from a reverse surface of the first contacting portion 32, and the securing holes 312 of the second locking portion 34 engage with the latches 2282 of the lower frame 22. Thus, electrical card received in the lower connector 20 can be communicated to outside through the FPC 30.

Figure 6:
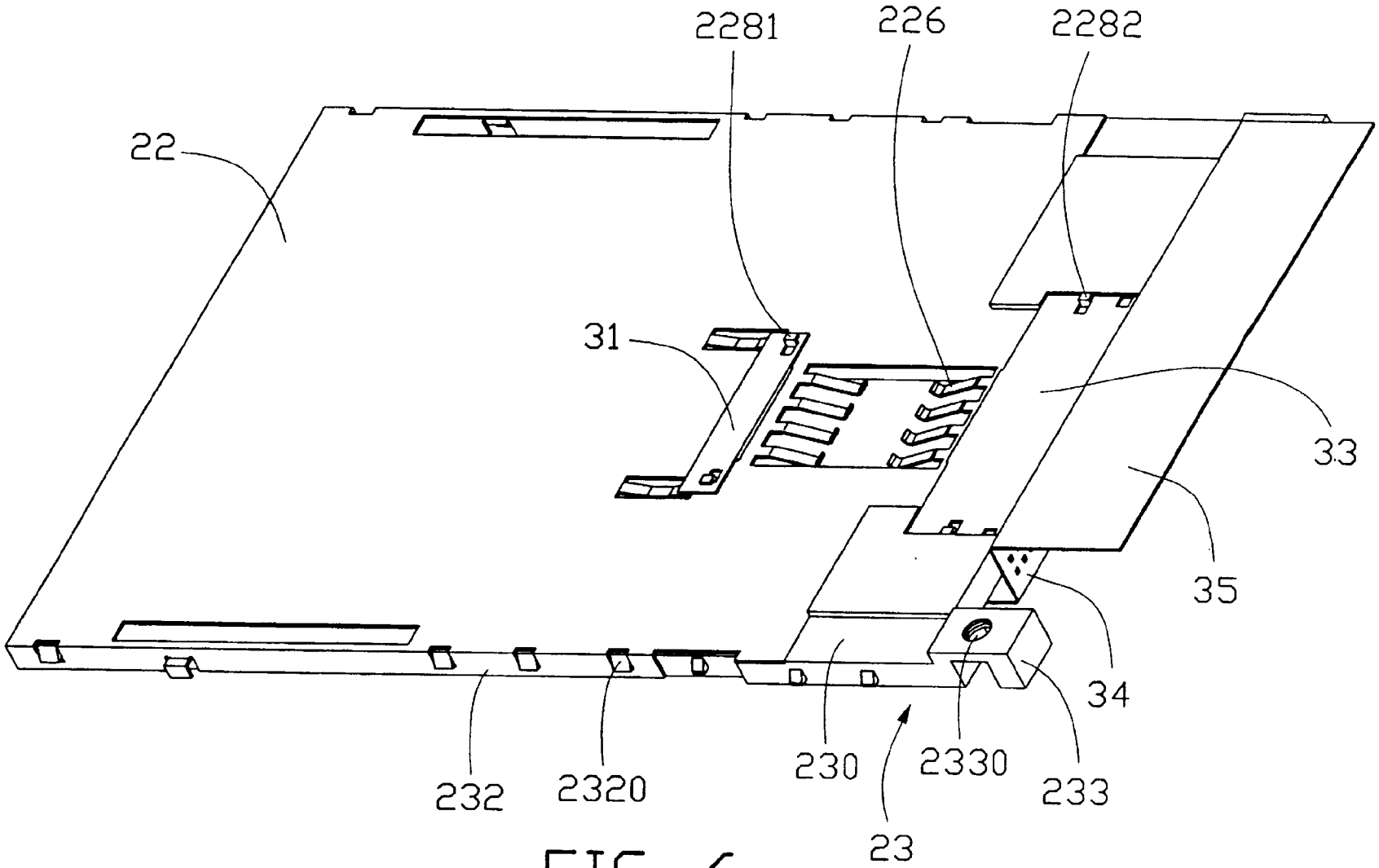
FIG. 6 is a perspective view showing the subassembly of FIG. 4 assembled on a lower insulative header of the lower connector.

FIG. 6 shows the subassembly 50, which includes the FPC 30 and the lower frame 22, is assembled to an insulative lower header 23 to form the lower connector 20. The lower header 23 comprises a lower main body 230 and two parallel guiding arms 232 extending out from opposite ends of the main body 230. Each arm 232 has a plurality of ribs 2320 defined thereof for engaging with corresponding locking holes 2220 of the lower frame 22 to secure the base plate 220 of the lower frame 22. The second locking portion 33 of the FPC 30 is located at a middle portion of the main body 230 with the second contacting portion 34 being located beyond the main body 230. The main body 230 further defines a pair of lower locating blocks 233 at opposite ends thereof and each block 233 defines a screw hole 2330 therein.

Figure 7:
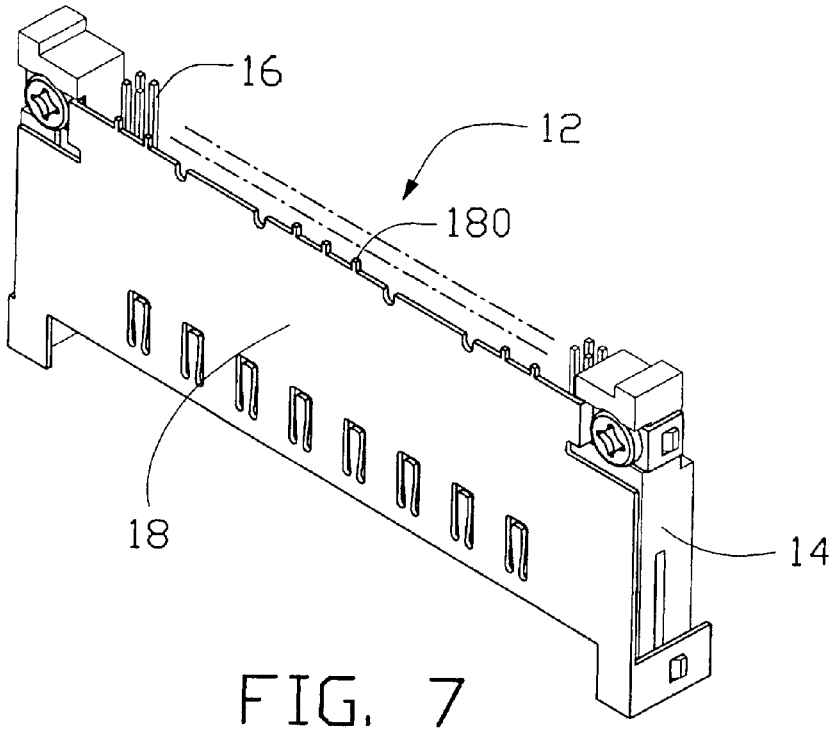
FIG. 7 is a perspective view of an upper header of the upper connector of FIG. 1.
Figure 8:
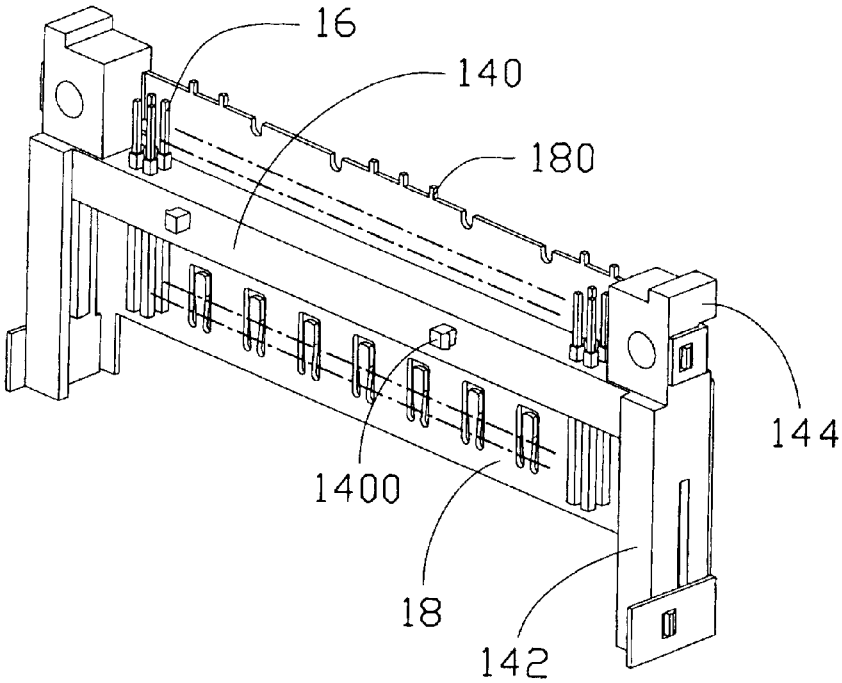
FIG. 8 is another perspective view of the upper header of the upper connector of FIG. 1.

Referring to FIGS. 7 and 8, an upper header 12 of the upper connector 10 comprises an insulative upper main body 14, a plurality of signal contacts 16 received in the main body 14, and a shield 18 covering the main body 14. The main body 14 has a middle bar 140, a pair of spaced upper guiding arms 142 extending towards one side of the middle bar 140, and a pair of upper locating blocks 144 extending towards the other side of the middle bar 140. The signal contacts 16 are arranged in two parallel rows and inserted in the middle bar 140. The shield 18 is covered on a top surface of the main body 14 with a plurality of spaced grounding pins 180 extending from one edge of the shield 18. The middle bar 140 of the main body 14 further has a pair of latches 1400 defined on a bottom surface 1402 thereof.

Figure 9:
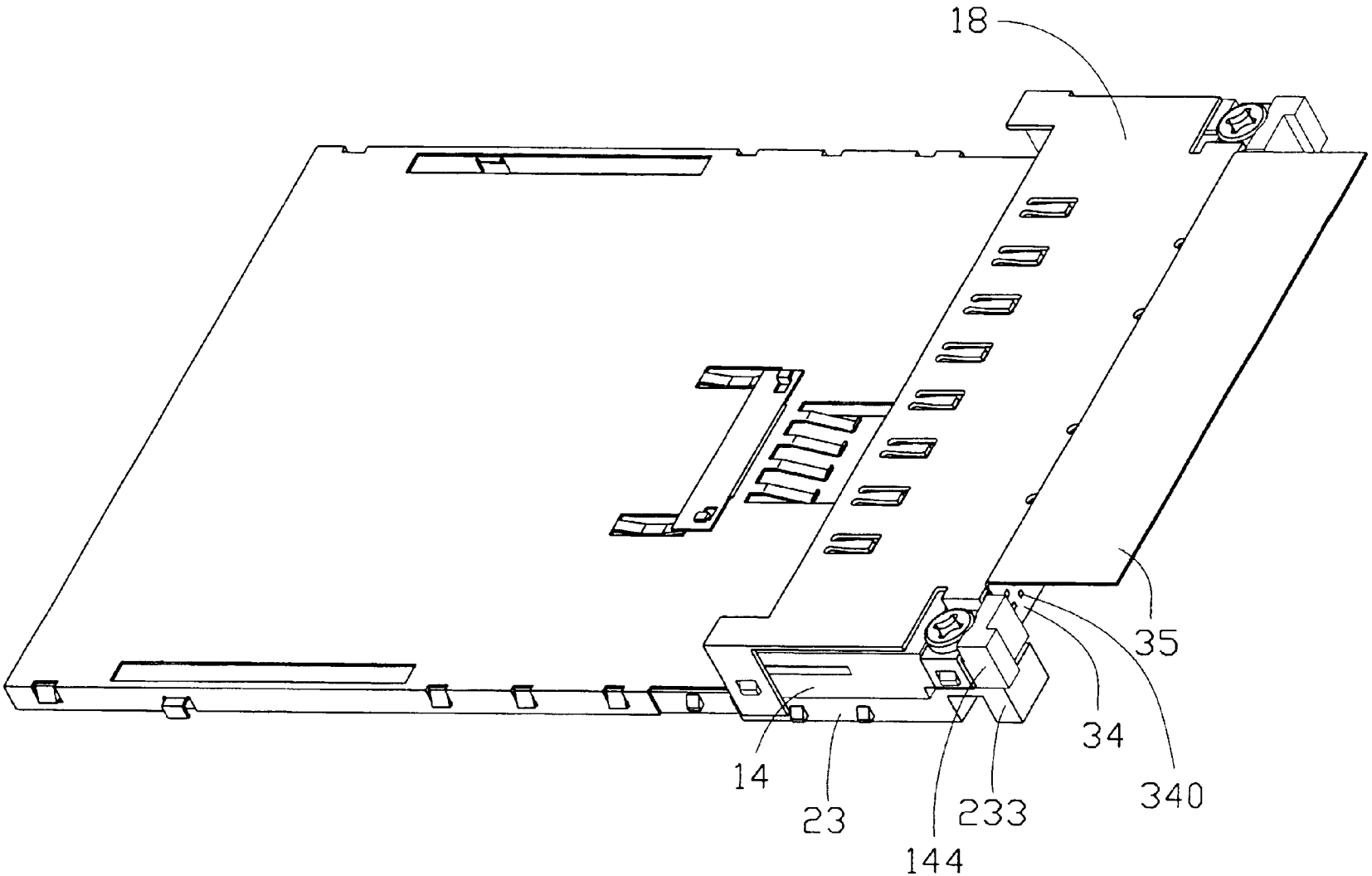
FIG. 9 is a perspective view of the assembly of FIG. 6 assembled on the upper header of FIG. 7.
Figure 10:
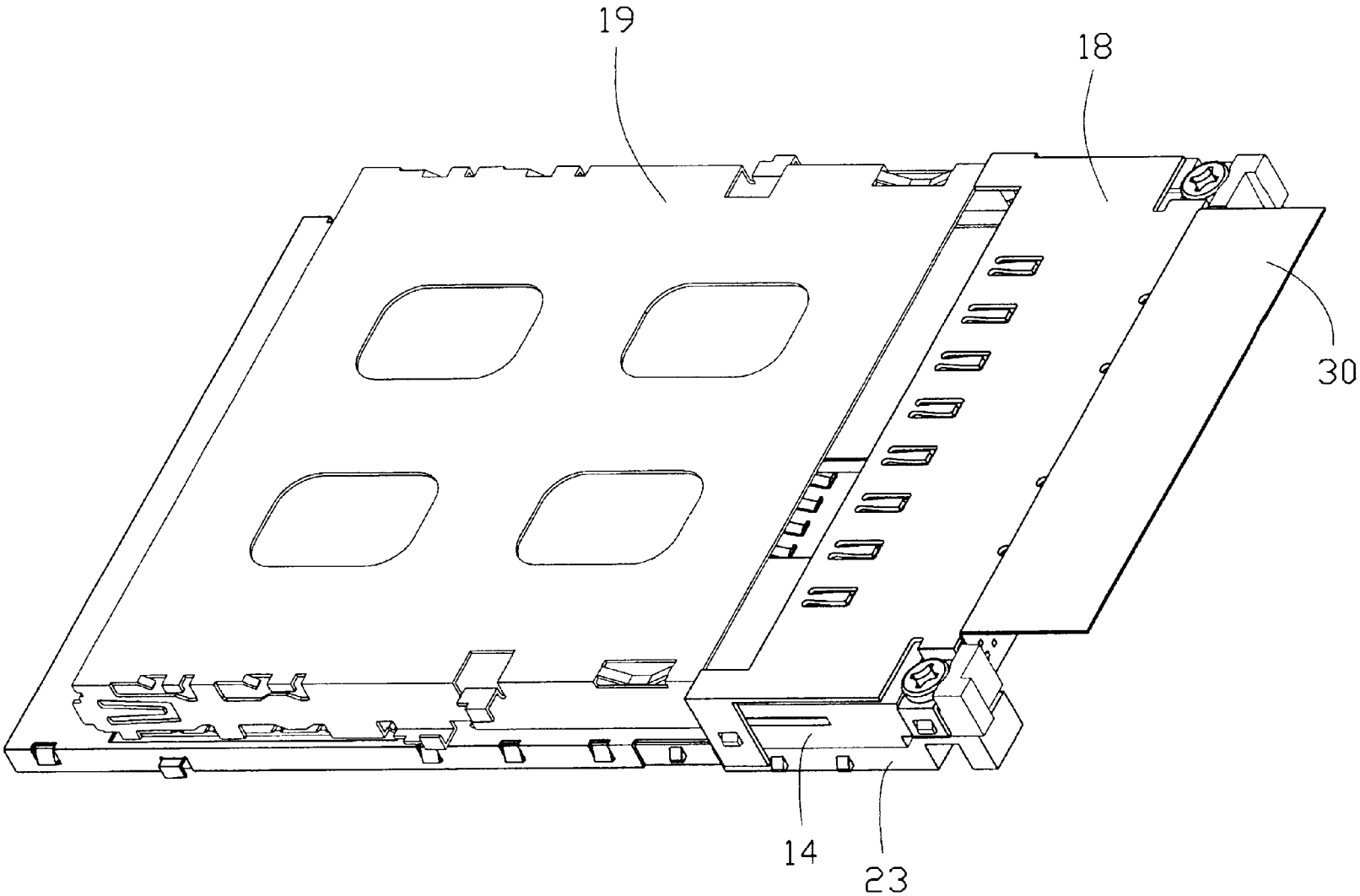
FIG. 10 is a perspective view of the electrical connector assembly of FIG. 1.

FIG. 9 shows the upper header 12 is assembled onto the lower connector 20. The upper header 12 is stacked on the lower header 22 of the lower connector 20 with the upper locating blocks 144 being positioned right over the lower blocks 233. The latches 1400 extend through the openings 332 of the second locking portion 33 and connect with the lower header 22. Also, the two rows of signal contacts of the upper header 12 are inserted into corresponding first solder holes 340 and the grounding pins 180 of the shield 18 are inserted into corresponding second solder holes 342. Therefore, electrical card received in the upper connector 10 can also be communicated to outside through the FPC 30. Referring to FIG. 10, an upper frame 19 is stacked on the lower frame 22 and connected to the upper guide arms 142 of the upper header 12. Thus, the whole electrical connector assembly 1 is achieved.

Referring to FIG. 1 again, when the connector assembly 1 is mounted on the PCB 2, the FPC 30 acts as a transition device therebetween. One end of the FPC 30 can simultaneously connect with the upper and lower connector 10, 20 while the other end of the FPC 30 can connect with a plug portion 440 of a board-to-board connector 4. Therefore, after two electrical cards (not shown while understandably being in fact a PCMCIA card and a Smart card) are respectively inserted into the upper and lower connector 10 and 20, data stored in the electrical cards received can be transferred by one transition device 30, and the transition device 30 can be expediently connect to a receptacle portion 41 of board-to-board connector 4 mounted on the PCB 2 without additional solder process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly mounted on a printed circuit board (PCB) for interconnecting inserted electrical cards with the PCB, comprising:

an upper connector having an insulative upper header and a plurality of electrical contacts received in the upper header;

a lower connector having an insulative lower header and a metallic frame assembled to the lower header, the frame having a plurality of spring arms; and a transition device having a first contacting and a second contacting portion, the first contacting portion being urged by the spring arms of the lower connector and the second contacting portion being connected with the electrical contacts of the upper connector, wherein the transition device comprises a flexible printed circuit (FPC), and the first contacting and second contacting portions being defined on the FPC;

wherein the first contacting portion has a plurality of solder pads defined on one side surface thereof, each spring arm of the lower frame bearing against the other side surface of the first contacting portion;

wherein the second contacting portion comprises a plurality of first and second solder holes defines therethrough;

wherein the electrical contacts of the upper header are received in the first solder holes;

wherein the upper connector comprises a shield covered on the upper header, the shield having a plurality of spaced grounding pins extending out from an edge thereof and received in the second solder holes;

wherein said frame defines an opening in which said spring arms extend.

* * * * *